US006896237B2

(12) United States Patent
Beh et al.

(10) Patent No.: US 6,896,237 B2
(45) Date of Patent: May 24, 2005

(54) CONTROL VALVE FOR A WATER CLOSET

(75) Inventors: Thomas P. Beh, Ypsilanti, MI (US); Raymond Bruce Martin, Bloomfield Hills, MI (US)

(73) Assignee: Geberit Technik AG (CH)

( * ) Notice: Subject to any disclaimer, the term of this patent is extended or adjusted under 35 U.S.C. 154(b) by 100 days.

(21) Appl. No.: 10/445,525

(22) Filed: May 27, 2003

(65) Prior Publication Data

US 2004/0021110 A1 Feb. 5, 2004

Related U.S. Application Data

(63) Continuation-in-part of application No. 09/827,736, filed on Apr. 6, 2001, now Pat. No. 6,732,997.
(60) Provisional application No. 60/195,094, filed on Apr. 6, 2000.

(51) Int. Cl.[7] ..... F16K 31/12
(52) U.S. Cl. ..... 251/35; 251/122; 251/903; 4/360
(58) Field of Search ..... 251/121, 122, 251/903, 35, 44; 137/903; 4/354, 359, 360, 361, 362

(56) References Cited

U.S. PATENT DOCUMENTS

| | | | | |
|---|---|---|---|---|
| 771,769 | A | * 10/1904 | Davies et al. | 239/424 |
| 1,104,292 | A | 7/1914 | Cowperthwaite | |
| 1,316,715 | A | 9/1919 | Haas | |
| 1,558,330 | A | 10/1925 | Bain | |
| 1,654,602 | A | 1/1928 | Reynolds | |
| 1,987,229 | A | 1/1935 | Curtin | |
| 2,182,980 | A | 12/1939 | Bruzenak | |
| 2,616,450 | A | 11/1952 | Legge et al. | |
| 2,715,228 | A | 8/1955 | McLanahan | |
| 3,011,176 | A | 12/1961 | Langdon | |
| 3,532,104 | A | 10/1970 | Hoen | |
| 3,563,384 | A | 2/1971 | DeLaney et al. | |
| 3,566,416 | A | 3/1971 | Altieri et al. | |
| 3,677,294 | A | 7/1972 | Gibbs et al. | |
| 3,817,279 | A | 6/1974 | Larson | |
| 3,820,171 | A | 6/1974 | Larson | |
| 3,820,754 | A | 6/1974 | Caron et al. | |
| 4,209,863 | A | 7/1980 | Lindauer | |
| 4,233,698 | A | 11/1980 | Martin | |
| 4,261,545 | A | 4/1981 | Allen | |
| 4,568,499 | A | 2/1986 | Wood | |
| 4,656,676 | A | 4/1987 | Dufau et al. | |
| 4,662,395 | A | 5/1987 | Strangfeld | |
| 5,046,201 | A | 9/1991 | Steinhardt et al. | |
| 5,241,711 | A | 9/1993 | Badders | |
| 5,361,426 | A | 11/1994 | Martin | |
| 5,406,652 | A | 4/1995 | Hennessy | |
| 5,435,019 | A | 7/1995 | Badders | |
| 5,970,527 | A | 10/1999 | Martin et al. | |

FOREIGN PATENT DOCUMENTS

| | | |
|---|---|---|
| DE | 237592 | 12/1909 |
| FR | 2196424 | 3/1974 |
| GB | 342879 | 2/1931 |
| GB | 447058 | 5/1936 |
| GB | 635737 | 9/1948 |
| GB | 1093277 | 11/1967 |

* cited by examiner

*Primary Examiner*—Edward K. Look
*Assistant Examiner*—John K. Fristoe, Jr.
(74) *Attorney, Agent, or Firm*—Reinhart Boerner Van Deuren s.c.

(57) ABSTRACT

An improved control valve in combination with a pressurized water closet having a housing, a spool rotatable within the housing, a valve stem threading engaging the spool but fixed from rotating relative to the housing and a needle valve extending from the valve stem and into the housing orifice, creating a self cleaning valve adjustable by rotating the spool, which adjusts the depth of the needle valve in the orifice, and thus adjusting the effective opening of the orifice.

21 Claims, 5 Drawing Sheets

CONTROL VALVE FOR A WATER CLOSET

This Application claims priority from Provisional Application No. 60/195,094 Filed: Apr. 6, 2000; And is a Continuation in Part of U.S. patent application Ser. No. 09/827,736, filed Apr. 6, 2001, now U.S. Pat. No. 6,732,997.

BACKGROUND OF THE INVENTION

1. Field of the Invention

The present invention relates to an improved control valve for a pressurized water closet, and such a valve in combination with a pressurized water closet that precisely regulates the refill volume of a toilet bowl.

2. Related Art

The basic components of a pressurized water closet are a water vessel, a flush valve and a flush valve actuator. The aforesaid components are generally installed internally of a conventional water closet. The pressurized water closet is energized by water pressure from a conventional fresh water supply system.

In operation, as the water level rises in the water vessel after flush, air internally of the water vessel is compressed. When water pressure in the vessel equals the supply line pressure or when it causes the pressure regulator valve to shut, in the event of supply line pressure greater than that allowed by the regulator, flow of water into the water vessel ceases and the system is conditioned for operation. When the flush valve actuator is actuated, the flush valve opens whereafter the compressed air in the water vessel pushes the water stored therein into the water closet bowl at relatively high discharge pressure and velocity, flushing waste therefrom with minimum water consumption.

The aforesaid features of the pressurized flush system result in stronger and more effective extraction and drain line carry, cleaner bowls, fewer drain line clogs, no hidden leakage of water between flushes, and smaller sized pipe systems. The system produces a flushing action which clears and cleans a toilet bowl while consuming less than one and six tenths gallons of water while meeting the highest municipal codes. The toilet bowl is emptied by one flush without drain line "drop-off" common to many low water volume, or gravity-flow type toilets.

In operation, actuation of the manual operator creates a pressure differential across a flush valve piston disposed in a flush valve cylinder. The flush valve piston and a flush valve therefore move upwardly at a controlled rate.

Upward or opening movement of the flush valve permits water to be ejected into the toilet bowl from the water vessel under relatively high pressure effecting extraction of the contents of the toilet bowl. Flush commences simultaneously with manual depression of the flush valve actuator and is time controlled so as to produce a prolonged high energy surge of water which carries bowl waste into the sewer.

Closure of the flush valve is timed by the distribution ratio of incoming water to the upper chamber of the flush valve cylinder and the water vessel. When the manual flush valve actuator is released, the fluid flow path from the upper chamber of the flush valve cylinder to ambient is closed. At this point, a predetermined portion of the water supplied under pressure from the water supply system flows directly to the upper chamber of the flush valve cylinder. The remaining portion of water supplied by the system flows to the main chamber of the water vessel. When the upper chamber of the flush valve cylinder is filled, and the flush valve is closed, all incoming water is directed into the water vessel.

Water rising in the water vessel under regulated water system pressure compresses the air entrapped therein until it reaches either the line or regulated pressure of approximately 30 psi, whichever occurs first. At this point, flow stops and the system is ready to be flushed again.

SUMMARY OF THE INVENTION

Current control valves for pressurized water closet flushing systems do not permit the ready and simple adjustment of the predetermined portion of the water supplied under pressure while maintaining a flush action independent of actuator depression and a self-cleaning action.

Specifically, the present invention provides a ready and simple manual adjustment of the amount of water to be provided in a flush (the refill volume) while maintaining a flush action independent of actuator depression. The present invention also provides a self-cleaning action.

DETAILED DESCRIPTION OF THE PREFERRED EMBODIMENT

Figure 1:
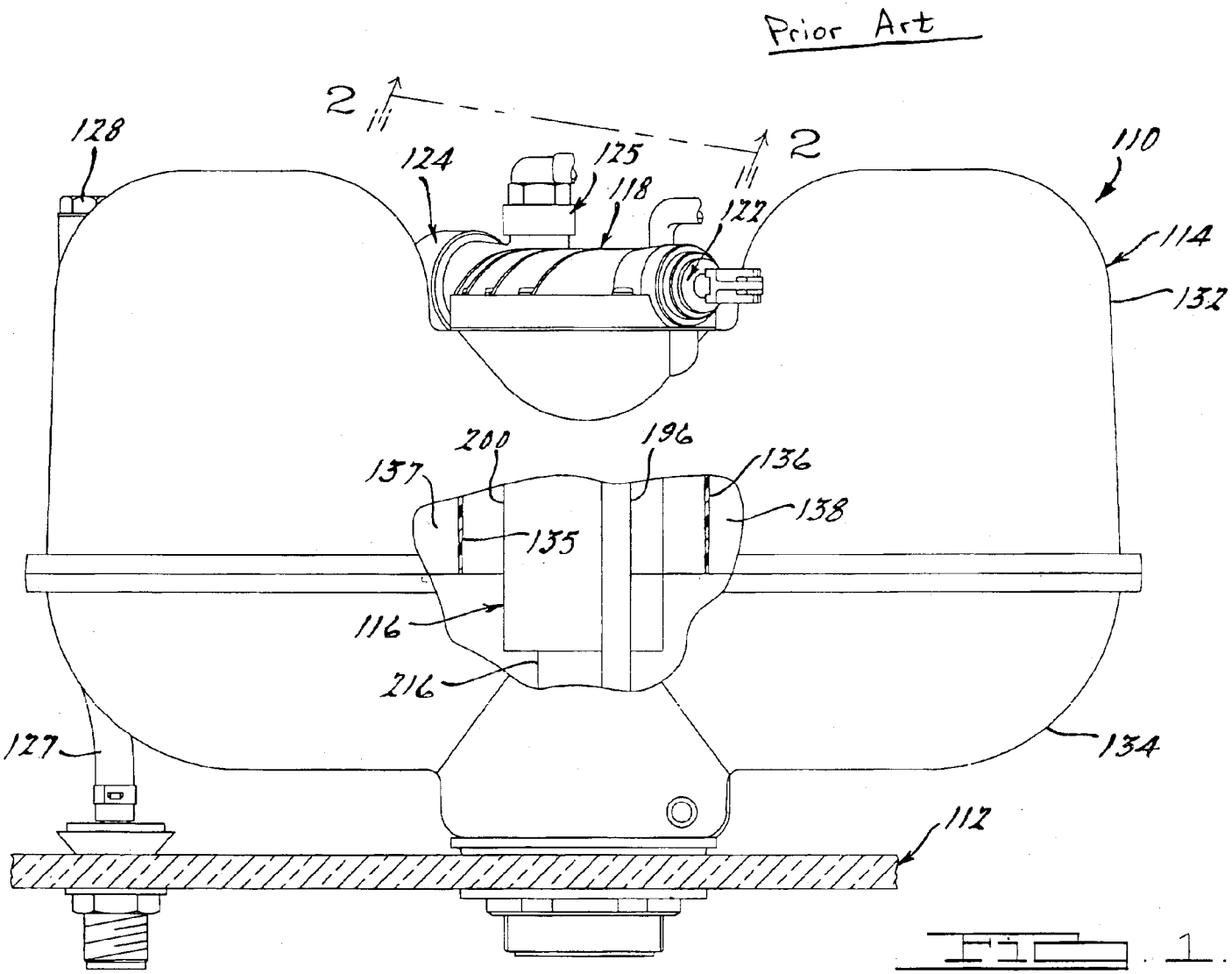
FIG. 1 is an elevational view of a water closet flushing system.
Figure 2:
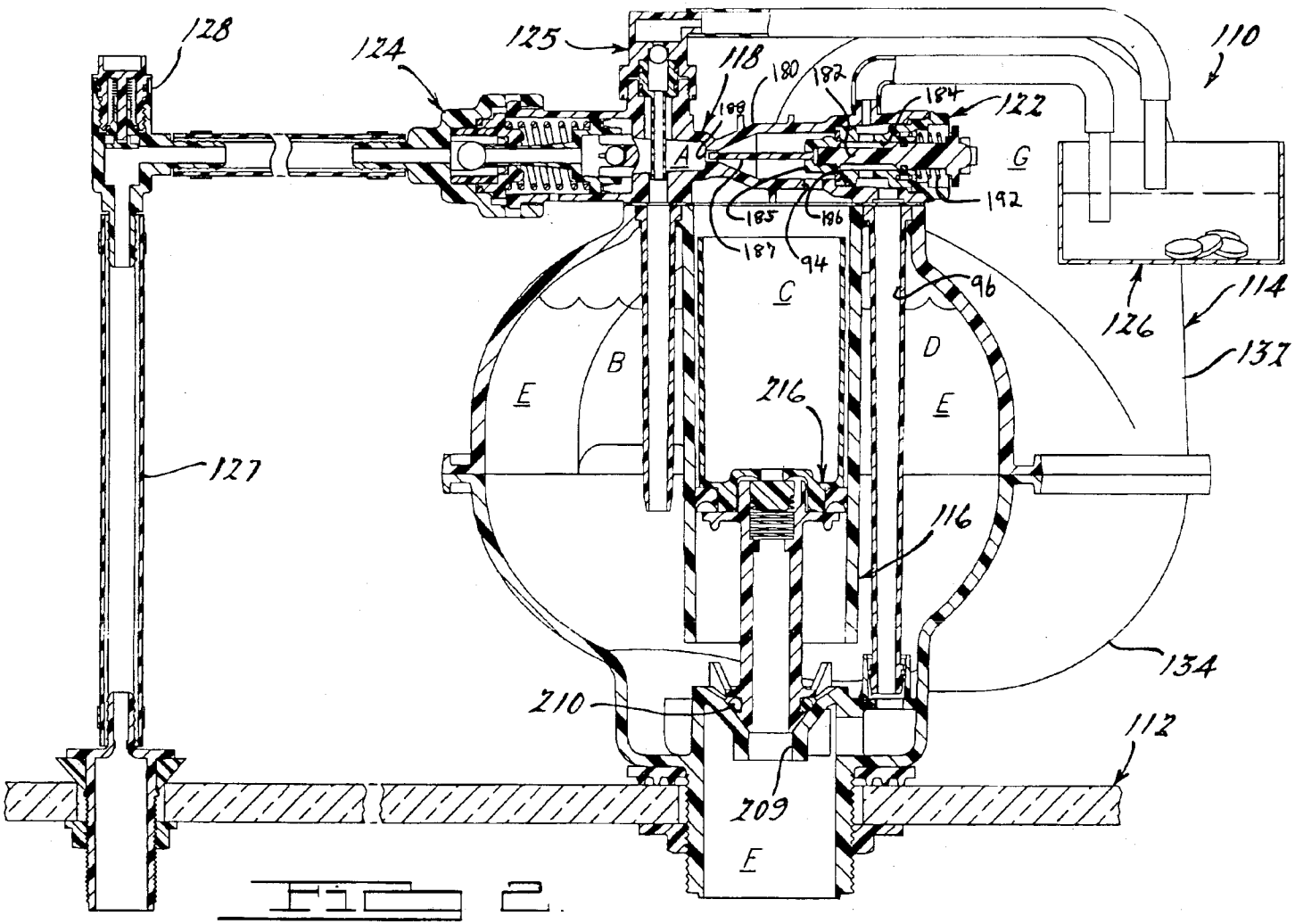
Prior Art FIG 2
FIG. 2 is a cross sectional view taken along the line 2—2 of FIG. 1 of a fully charged pressurized water closet flushing system according to the prior art.

As seen in FIGS. 1 and 2, a pressurized water closet flushing system 110, in accordance with a known design represented by U.S. Pat. No. 5,970,271 to Martin, et al, is shown in operative association with a conventional water closet tank 112. Major components of the system 110 are a water vessel 114, an internal flush valve assembly 116, and a manifold 118 comprising an integral flush valve actuator 122, a water pressure regulator 124, an air induction regulator 125, a disinfectant reservoir 126.

Water is supplied to the system 110 from a pressurized source (not shown) and flows upwardly without restriction through an inlet conduit 127 and vacuum breaker 128, thence laterally to the manifold 118. Water is free to flow through the conduit 127 to the manifold 118 at system pressure thence, after regulation, to both the flush valve assembly 116 and water vessel 114, as will be described.

In the preferred constructed embodiment disclosed, the water vessel 114 comprises a pair of vertically stacked half sections 132 and 134. The upper section 132 of the water vessel 114 has a pair of downwardly extending partitions 135 and 136 that create isolated chambers 137 and 138, respectively, as long as the water level is above the weld joint between the sections 132 and 134 of the water vessel 114, a typical condition between flushes. Accordingly, because the compressed air in the chambers 137 and 138 which powers the system 110 is isolated, a leak in an upper portion of the flush valve assembly 116 will not result in the system 110 becoming waterlogged.

The manifold 118, comprising the water pressure regulator 124, air induction regulator 125 and flush valve actuator 122, is mounted on the upper section 132 of the water vessel 114.

The manifold 118 also includes the flush valve actuator 122 according to the existing art, which comprises a cylindrical housing 180 with a manually operable spool 182 disposed internally thereof that is slidably journaled in a sleeve 184. The spool 182 carries a valve 185 that is normally seated on a valve seat 186. A needle valve 187 is supported on one end of the spool 182 so as to extend into an orifice 188 in the housing 180 to define the area of an annular water inlet orifice that controls the flow of water to the flush valve 116.

Movement of the spool 182 of the flush valve actuator 122 against the bias of a spring 192 moves the valve 185 off its seat 186 to open communication between an upper chamber "C" of the flush valve 16, through an orifice 94 to a pressure relief tube 96 to initiate flush. The tube 96 communicates with ambient pressure in the toilet bowl (not shown).

In operation, the water vessel 114 is fully charged with air and water and the system 110 is ready for flush. Zones (A), (B), (C) and (E) are pressurized. Zones (D), (F), and (G) are at atmospheric pressure. Flush occurs when the actuator spool 182 of the flush valve actuator 122 is depressed, allowing pressurized water in zone "C" to discharge through the actuator 122 into zone "D" thence to zone "F" as well as to flow through the water inlet conduit. The pressure differential established between zone "E" and zone "C" forces the piston 216 of the flush valve assembly 116 to life, creating an escape path for water in zone "E" through the discharge aperture 209 into the toilet bowl at zone "F". It is to be noted that the piston 216 of flush valve assembly 116 lifts, for example, 0.40 inches, discharging only a corresponding volume of water from zone "C". This volume of water is determined to be the amount of water capable of being discharged through the flush valve actuator 22 in ¼ second. As a result, the same amount of water is required after each flush to refill zone "C" and cause the flush valve 210 to seal regardless of whether the spindle 182 of the flush valve actuator 122 is depressed for more than ¼ second.

As flush progresses, pressure in zone "E" begins to lower, allowing the regulator 124 to begin opening and flow to begin through zone "A" to zones "B" and "C", flow through zones "A" and "B" is at maximum when pressure within vessel "E" is zero.

It is to be noted that the size of the needle valve orifice 188 in conjunction with the needle valve 187 controls the flow rate of new water into the upper chamber "C" of the flush valve 116. Clogging of the annulus by particles in the water supply system is minimized because, when depressed, the needle valve 187 clears any foreign matter that lodges in the orifice 188.

Refill volume of the toilet bowl utilizing this existing valve actuator can be varied by varying the diameter of the orifice 188 in conjunction with the diameter of the needle valve 187, which varies the ratio of water passed into zone "C" respectively, thus speeding or slowing movement of the piston 216 and closure of the flush valve assembly 116 after flushing and/or the amount of bowl refill water passed through the water vessel 114 to the toilet bowl (not shown). As a result, the system 110 can be precisely tuned to different bowl configurations to obtain maximum water conservation and performance. The present invention provides an external manual adjustment for the bowl refill volume.

Figure 3:
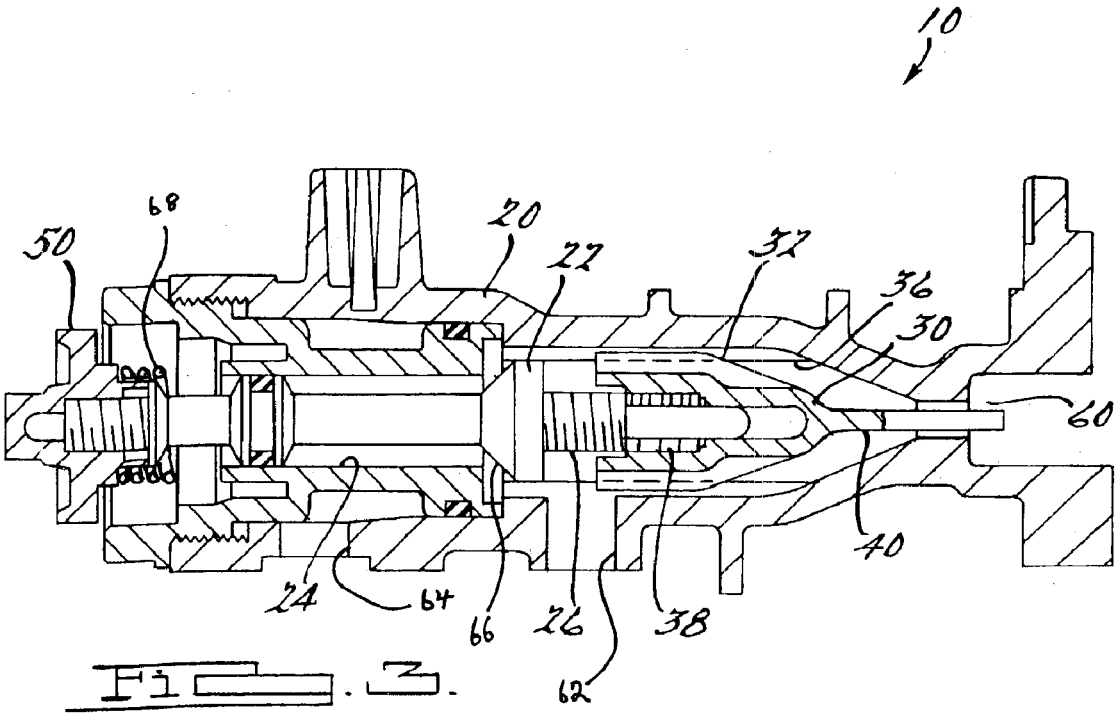
FIG. 3 is a cross sectional view of the instant invention wherein the metering pin is maximally advanced.
Figure 4:
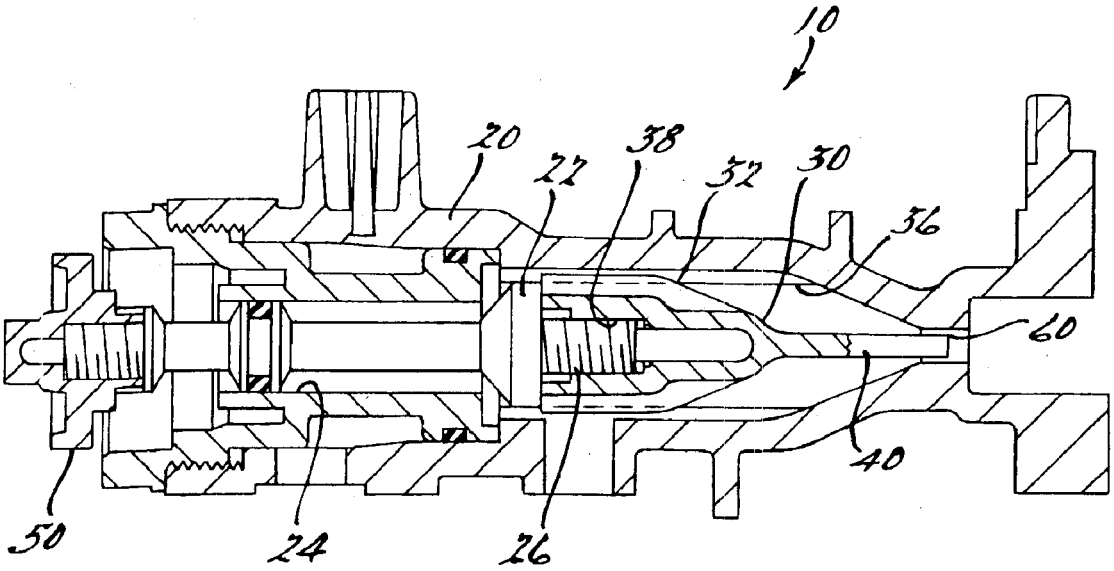
FIG. 4 is a view similar to FIG. 1 wherein the metering pin is minimally advanced.

Referring to FIGS. 3 and 4 and in accordance with a preferred constructed embodiment of the instant invention, an adjustable fluid metering valve 10 comprises a generally cylindrical housing 20 with a manually operable spool valve member (hereafter "spool") 22 disposed internally thereof that is slidably journaled on a sleeve 24. The spool 22 has an externally threaded portion 26 at one end thereof that rotatably engages a generally right circular cylindrical valve stem 30. In a preferred embodiment, housing 20 defines an inlet 62, through which water from zone C can enter housing 20 during a flush event, when used in conjunction with a pressurized water closet, for instance, the water closet described herein. Housing 20 further defines an outlet 64, for discharge of water to zone F. Between flushes, spool 22 is preferably biased against a seat 66 by action of a biasing spring 68 acting on knob 50, and thereby blocks fluid communications between inlet 62 and outlet 64. When a flush event is initiated, knob 50 is pushed axially inward relative to housing 50, lifting spool 22 from seat 66, and establishing fluid communications between inlet 62 and outlet 64.

Figure 5:
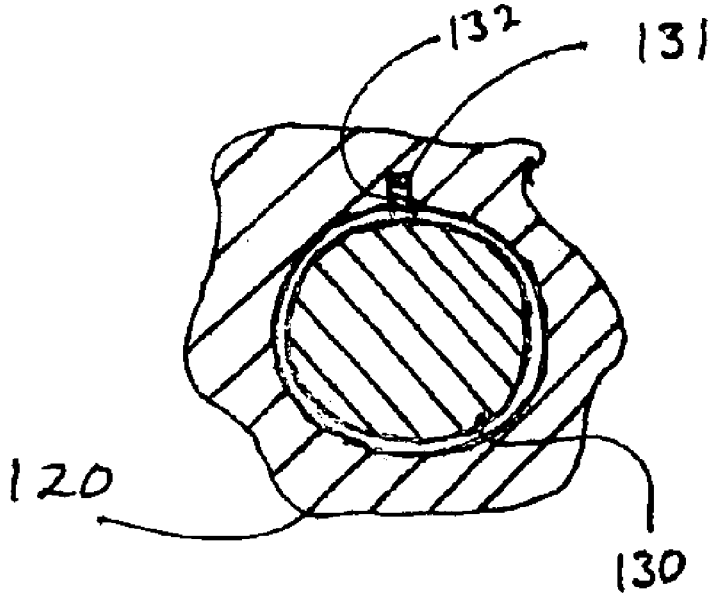
FIG. 5 is a sectioned axial view of a valve similar to the valve shown in FIGS. 3 and 4.

The valve stem 30 is slidably journaled in the cylindrical housing 20 and has a plurality of longitudinal grooves or slots 32 therein, that engage a plurality of splines or tabs 36 protruding from the interior of the housing 20, restricting or preventing rotation of the valve stem 30 with respect to the housing 20. The valve stem 30 further has an internally threaded portion 38 that is engaged by the externally threaded portion of the spool 22. An alternative embodiment is shown in FIG. 5, illustrating a sectioned view of a control valve. In the FIG. 5 embodiment, a splined valve stem 130 is shown positioned within a housing 120. Valve stem 130 includes at least one longitudinal spline 132 that is received in a groove 131 in housing 120. Various modifications, including number of spline-groove pairs, dimensions of the splines and grooves, etc., could be made to the FIG. 6 embodiment without departing from the scope of the present invention, so long as the valve stem 130 is "limited in rotation in the housing." Still further embodiments (not shown) might utilize a square, oval or otherwise non-circular valve stem, and the rotation-limiting features disclosed herein should therefore not be taken to limit the scope of the present invention. It is only necessary that the respective shapes of housing 20 and valve stem 30 be such that valve stem 30 cannot rotate therein when spool 22 is rotated by manipulation of knob 50. An alternative embodiment (not shown) might utilize a spool that is fixed from rotation, and a valve stem rotatable with respect to the housing. A rod could be positioned in a longitudinal bore in the spool, and connected to the external knob. In such a design, the valve stem could be fixedly mounted to the rod, and axially adjusted by a threaded engagement of the rod with the longitudinal bore in the spool. In a manner similar to other disclosed embodiments, such a design would allow actuation of the internal flush valve assembly in response to inward displacement of the external knob 50, lifting the spool from its seat and opening fluid communications past seat 66.

The spool 22 is rotated by an external manual adjustment knob 50. As the spool 22 rotates, the valve stem 30 is restricted from rotation, and thus is driven by the rotation of the spool threads to slide inwardly or outwardly, depending upon the direction of rotation. Although the illustrated embodiments include an internally threaded valve stem and an externally threaded spool, this relationship might be reversed without departing from the scope of the present invention. A needle valve pin 40 is supported on one end of the valve stem 30 so as to extend into an orifice 60 in the housing 20 to define the area of an annular water inlet orifice that controls the flow of water to, for example, a flush valve in a water closet. The maximum diameter of the needle valve pin 40 is less than the diameter of the orifice 60 such that fluid communication therethrough is not interrupted by the action of the valve.

The orifice 60 in conjunction with the needle valve pin 40 of the instant invention minimizes the lodging of any foreign matter in the orifice 60 as the needle valve pin 40 can be readily advanced past the orifice to clear any obstruction therein. As used herein, the term "orifice" should be understood as referring to the three-dimensional, narrowed region of housing 20 into which pin 40 can extend.

Figure 6:
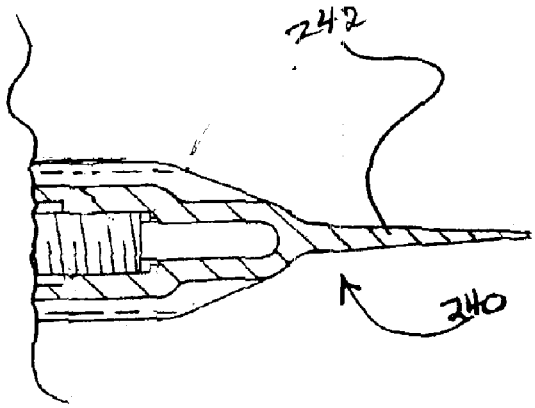
FIG. 6 is a side view of a valve according to a preferred embodiment of the present invention wherein the needle valve pin is tapered.

When an adjustable flush valve actuator according to the present invention is used in conjunction with a pressurized water closet, as for example disclosed in U.S. Pat. No. 5,970,527 to Martin, et al, the refill volume of a toilet bowl can be varied by varying the diameter of the orifice 60 by advancing the needle valve pin 40 therein, which varies the volume of water passed into a pressurized chamber of the water closet (not shown) to obtain maximum water conservation and performance. The depth of penetration of the needle valve pin 40 in orifice 60 affects a fluid flow rate therethrough. Further, the valve pin may be tapered to allow for a more dramatic variation of volume control for a given rotation of the control knob. An illustrative embodiment of a valve stem 240 having a tapered valve pin 242 is shown in FIG. 6. Other degrees of taper and lengths of the tapered region might be utilized in other embodiments (not shown), depending on the desired performance characteristics. For instance, where a particularly dramatic difference in refill volume is desired for a given rotation of the control knob 50, the needle valve pin 40 can be designed with a relatively short length of the tapered region, and a relatively steep degree of tapering. Further, use of tapered pins having flattened end surfaces is contemplated, similar to the pins shown in FIGS. 3 and 4, as well as embodiments having pins that taper to a point, as in a conventional needle valve. Still other embodiments (not shown) could utilize a straight/cylindrical valve pin in conjunction with a tapered orifice that narrows in a direction away from the valve stem, to achieve a similar effect. Again, in such an embodiment significant variation in the dimensions and degree of the tapered region could exist without departing from the scope of the present invention.

While the preferred embodiment of the invention has been disclosed, it should be appreciated that the invention is susceptible of modification without departing from the spirit of the invention or the scope of the subjoined claims.

What is claimed:

1. An adjustable fluid metering valve in combination with a pressurized water closet comprising:

a housing having an orifice a spool valve member rotatably and slidably contained within said housing, said spool valve member having a first end and a second end, said second end of said spool valve member being threaded;

a valve stem slidably contained within said housing, said valve stem having a first threaded end threadingly engaging said spool valve member and a second end having a needle valve pin aligned with said orifice;

said valve stem limited in rotation within said housing; wherein rotation of said spool valve member relative to said valve stem drives said valve stem axially with respect to said orifice, thereby adjusting a refill volume of said pressurized water closet.

2. The valve combination of claim 1 wherein said spool valve member is externally threaded.

3. The valve combination of claim 1 wherein said spool valve member is internally threaded.

4. The valve combination of claim 1 wherein said needle valve pin is extensible past the orifice.

5. The valve combination of claim 4 wherein said needle valve pin has a substantially flat end surface.

6. The valve combination of claim 1 wherein said orifice has a narrowing taper in a direction away from said valve stem.

7. The valve combination of claim 1 wherein said needle valve pin is tapered.

8. The valve combination of claim 7 wherein said needle valve pin narrows in diameter in the direction of its tip.

9. The valve combination of claim 1 wherein axial adjustment of said valve stem adjusts an axial position of said needle valve pin with respect to said orifice, thereby adjusting a refill volume of said water closet.

10. The valve combination of claim 1 wherein said orifice has a narrowing taper in a direction away from said valve stem.

11. A control valve for a pressurized water closet comprising:

a housing having an orifice;

a spool valve member rotatably and slidably contained within said housing, said spool valve member having a threaded end;

a valve stem slidably contained within said housing, said valve stem having a first threaded end engaging the threaded end of said spool valve member and a second end having a needle valve pin aligned with said orifice;

said valve stem limited in rotation within said housing, wherein rotation of said spool valve member relative to said valve stem drives said valve stem axially with respect to said orifice, thereby adjusting a fluid flow rate therethrough.

12. The control valve of claim 11 wherein said valve stem is non-circular.

13. The control valve of claim 11 wherein said valve stem includes at least one longitudinal spline received in a groove in said housing.

14. The control valve of claim 11 wherein said housing includes at least one spline received in a longitudinal groove in said valve stem.

15. The control valve of claim 11 wherein said pin is tapered.

16. A pressurized water closet wherein a pressurizeable water vessel is fluidly connectable with a bowl via an internal flush valve assembly, said water closet comprising:

a control valve housing having an inlet orifice and an internal valve seat;

a valve stem slidable in said housing and rotatably limited therein, said valve stem having a pin aligned with said inlet orifice;

a spool valve member complementary with said valve seat and rotatable and slidable in said housing, said spool valve member having a threaded end engaging said valve stem; wherein rotation of said spool valve member drives said valve stem axially with respect to said orifice, a position of said pin with respect to said orifice defining a refill volume of said bowl.

17. The pressurized water closet of claim 16 wherein said spool valve member is slidable from said valve seat, thereby providing fluid communications past said valve seat.

18. The pressurized water closet of claim 16 wherein said spool valve member is connected to a knob at least partially external of said housing.

19. The pressurized water closet of claim 16 wherein said hosing defines an outlet fluidly connecting an interior of said housing with said bowl, and an inlet fluidly connecting an interior of said housing with an upper chamber of the flush valve assembly; wherein sliding said spool valve member from said seat fluidly connects said inlet with said outlet.

20. The pressurized water closet of claim 16 wherein said pin on said valve stem is tapered.

21. The pressurized water closet of claim 16 wherein said orifice has a narrowing taper in a direction away from said valve stem.

* * * * *